United States Patent [19]

Cherrington

[11] 4,135,586

[45] Jan. 23, 1979

[54] APPARATUS FOR CONSTANTLY ROTATING CASING DURING INSTALLATION

[76] Inventor: Martin D. Cherrington, 1111 S. Post Oak Rd. #225, Houston, Tex. 77056

[21] Appl. No.: 778,914

[22] Filed: Mar. 18, 1977

[51] Int. Cl.[2] ..... E21B 19/16; E21C 19/00

[52] U.S. Cl. ..... 173/147; 173/164; 175/57; 175/61; 175/85

[58] Field of Search ..... 175/57, 62, 61, 73, 175/171, 195, 52, 85, 170; 173/149, 164, 147

[56] References Cited

U.S. PATENT DOCUMENTS

| | | | |
|---|---|---|---|
| 3,399,735 | 9/1968 | Ikeda | 173/149 |
| 3,662,611 | 5/1972 | Knoll | 173/149 |
| 3,708,020 | 1/1973 | Adamson | 173/149 |
| 3,878,903 | 4/1975 | Cherrington | 175/45 |
| 3,892,140 | 7/1975 | Fox et al. | 175/195 |
| 3,919,902 | 11/1975 | Johnson | 173/164 X |
| 4,003,440 | 1/1977 | Cherrington | 175/171 |

*Primary Examiner*—Ernest R. Purser
*Attorney, Agent, or Firm*—Townsend and Townsend

[57] ABSTRACT

An inclined drill rig is disclosed with attached rotatable power tongs for use in practicing a process for the installation of underground casing. The underground casing is usually installed coaxially to a pilot string disposed about an invert arcuate underground path underneath an obstacle, such as a river. The underground casing is installed in discrete segments from a slanted drill rig unit including a car traveling on an inclined ramp. The traveling car on the inclined drill rig ramp crowds and rotates each pipe segment sequentially into the ground from a rotating table. When the last pipe segment attached is fully advanced into the ground, it is clamped at power tongs located at the front of the ramp. These power tongs apply torque to rotate all the casing in the ground without crowding the casing.

6 Claims, 9 Drawing Figures

APPARATUS FOR CONSTANTLY ROTATING CASING DURING INSTALLATION

Figure 1:
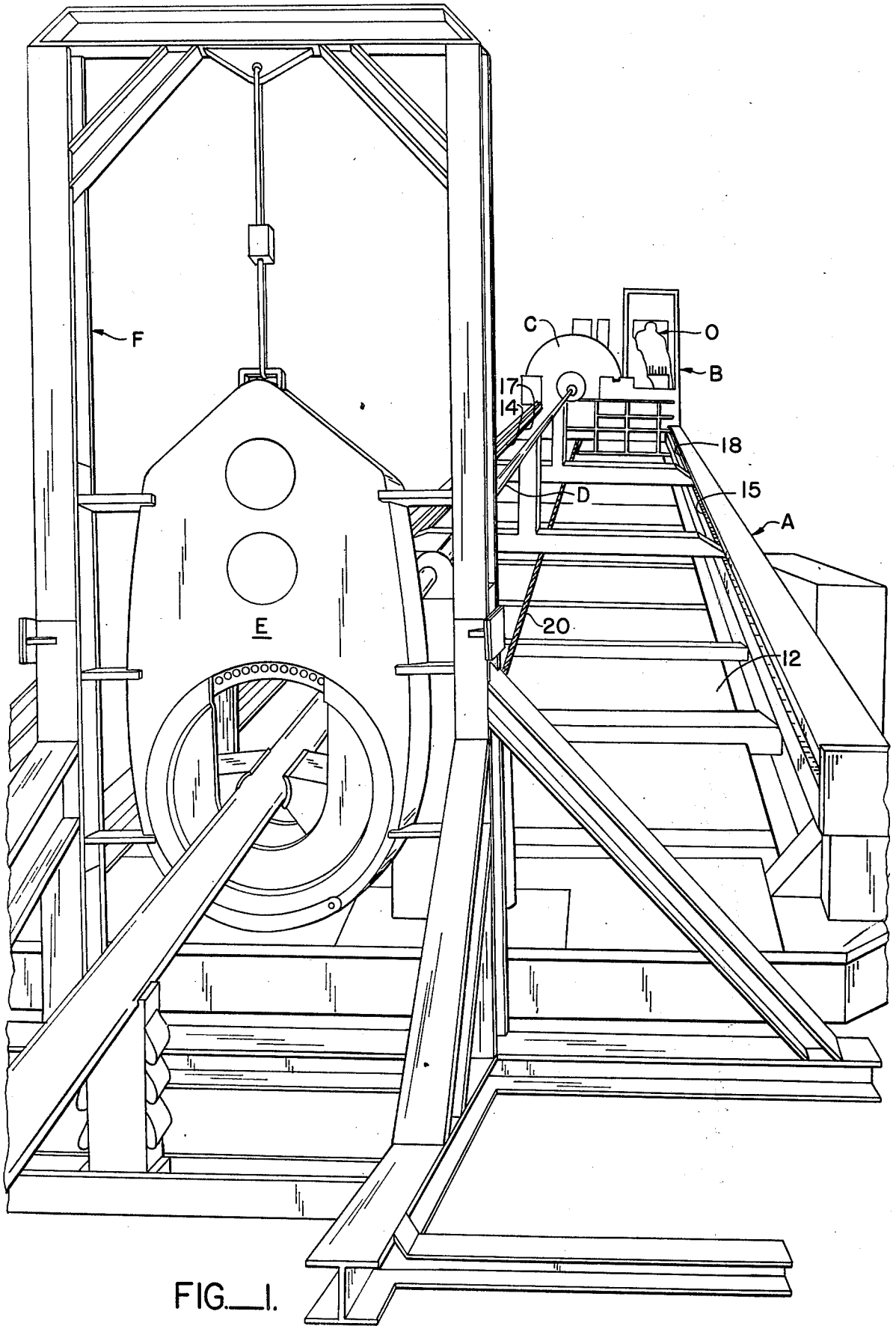

This invention relates to an apparatus and process for installing production casing into the ground. More particularly, this invention is a process of utilizing periodic casing rotation during advancement into the ground of pipe along an inverted, arcuate path. The rotation is made to alleviate static earth friction problems peculiar to the placement of casing installed in an inverted, arcuate path underneath an obstacle such as a river.

SUMMARY OF THE PRIOR ART

It is known to install dirt-exposed casing coaxially about an inverted, arcuate drill path. Such an inverted, arcuate drill path has been previously emplaced with a pilot string. Typically, the production casing is coaxially installed over the pilot string so as to travel to and about and be guided in its path by the previously installed pilot string. Usually, the pilot string is bored in a carefully controlled path. This path includes, among other parameters, a radius of curvature which is tolerable by the finally installed production casing.

Production casing is usually installed in discrete segments. As each segment of pipe is joined to a previously installed segment, all torsional force on the string of pipe in the ground is relaxed.

SUMMARY OF THE PROBLEM

It has been found that when the production casing is installed, it is subjected to many stresses. First, when installed, this dirt-exposed casing must follow an inverted, arcuate path of the drill string. This path must have such a radius of curvature so that the increased section of the pipe of the production casing is not strained beyond the strength of the material of the pipe wall. Naturally, as the circular section of the pipe becomes larger, the radius of curvature to which the pipe may be bent becomes smaller because of the increased section of the pipe. Thus the subsequently installed production casing can tolerate a lesser radius of curvature than the initially installed pilot string.

Secondly, the production casing, when bent to conform to the invert arcuate path of the pilot string must be rotated as bent as it is installed about the production casing. This rotation of the production casing as bent in an inverted, arcuate contour subjects the walls of the dirt-exposed casing to still an additional stressing, commonly a stress reversal.

Heretofore it has been common to relax all torsion forces on the production casing as each discrete segment is installed at the bitter end of the rig. Where there are unavoidable delays at the bitter end of the rig such as those associated with welding and non-destructive testing (as by X-ray) of a welded joint, sticking problems of the pipeline peculiar to the installation of a casing along an invert arcuate path occur.

First, where the length of dirt-exposed casing placed within the ground is long, where there is a complete relaxation of torque on the pipe, torsional elasticity of the pipe relaxes from the forward end to the rear end of the string. This force is a torsional spring force which is considerable where the casing is advanced in length of over 200 feet into the ground.

Secondly, and in addition to the relaxing of the torsion force, there is a static skin friction force exerted by the surrounding ground on the pipe. This static skin friction force increases with the length of time the production casing is maintained in the ground without rotation. This static coefficient of friction force builds to a considerable force, especially when the pipe is allowed to maintain a static position with the ambient ground over a period of time exceeding a few minutes duration.

When a pipe segment is joined to the bitter end of the drill string and drilling recommences, the torsion forces must be reestablished to rotate the pipe. Additionally and simultaneously with the restoration of the torsion spring forces, the skin friction of the pipe with the ambient ground must be broken. I have found and discovered that the overcoming of both these forces easily extends up to and exceeds twice the force necessary to maintain a casing under rotation.

When these friction and torsion forces are added to the normal stressing of the production casing during its installation along an inverted, arcuate path, a surcharge of the normal strength of material forces on the casing occurs. Breaking of the production casing interior of the ground frequently can and does occur.

It is again emphasized that the problems herein described are peculiar to the installation of an inverted, arcuate production casing along and under an obstacle such as a water course. This is to be distinguished from drilling in a substantially vertical direction wherein the pendulous forces acting upon the drill rig can be utilized to break free a drill string from friction forces, such as wedging of the drill string to one side of the hole. Moreover in vertical drilling, as distinguished from the drilling herein, percussive up and down movement of the string is always available; of course, it is not available where the drill string must follow an inverted, arcuate path.

SUMMARY OF THE INVENTION

An inclined drill rig is disclosed with attached rotatable power tongs for use in practising a process for the installation of underground casing. The underground casing is usually installed coaxially to a pilot string disposed about an invert arcuate underground path underneath an obstacle, such as a river. The underground casing is installed in discrete segments from a slanted drill rig unit including a car traveling on an inclined ramp. The traveling car on the inclined drill rig ramp crowds and rotates each pipe segment sequentially into the ground from a rotating table. When the last pipe segment attached is fully advanced into the ground, it is clamped at power tongs located at the front of the ramp. These power tongs apply torque to rotate all the casing in the ground without crowding the casing. During this non-crowding rotation of the installed casing at the rig, the traveling car with drill head retracts from the lower portion of the inclined ramp to the upper portion of the inclined ramp and another sequential segment of casing is moved into position. Joinder of the abutted segment can occur as by welding with non-destructive testing (preferably by X-ray). During delays incident to this joinder and testing of the pipe joint, rotation of the installed casing in the ground is periodically made by the power tongs. When joinder is completed, the drill table on the traveling car takes up the torque on the casing, the power tongs are released, and simultaneous crowding of the last attached drill string into the ground occurs.

OBJECTS AND ADVANTAGES OF THE INVENTION

An object of this invention is to disclose a process of installing a large diameter production casing. The process includes the step of crowding a dirt-exposed casing with or without rotation into the ground. This crowding is accompanied by the installation of a drill string at the rear end of the drill string in discrete segments.

As each segment is fully advanced into the ground, it is grasped and rotated without crowding while the next in order segment is installed, as by welding, at the drill rig end of the string. During this installation of a segment at the drill rig end of the string, rotation of the string occurs. Finally, and when joinder is completed, crowding and rotation of the casing into the ground recommences.

An advantage of this invention is that the buildup of a static coefficient of friction is avoided about the installed casing. The casing can be rotated and crowded into the ground with torque and thrust forces on an order of one half the forces required to break the casing free of the ground. By maintaining the rotation continuously, excessive static friction forces of the casing with respect to the ground need not occur.

A further advantage of this invention is that the torque forces along the full length of the drill string need not ever be lost. Rather, the drill string is maintained in a fully torqued disposition where these forces need not be recaptured. Energy is conserved.

Yet an additional advantage of this invention is that the total forces of bending and torsion required for the installation of dirt-exposed casing along such an inverted, arcuate path can be maintained at a minimum. When these forces are maintained at a minimum, casing can be installed along a sharper radius of curvature for longer lengths where higher overall torque forces are necessary for installation.

An additional advantage is that where nominal radii of curvature in lengths of pipe are utilized, an increased safety factor is enabled by the process of this invention.

Yet another object of this invention is to disclose an apparatus for practicing the disclosed process of torquing a production casing continuously while it is being installed in the ground. An inclined ramp has mounted thereto a traveling car with a rotating drill table or chuck. The drill table as mounted to the car travels from the rearward end of the ramp to the forward end of the ramp to crowd production casing rotatably into the ground. At the forward end of the drill rig there is mounted power tongs for rotating the production casing only. Between the drill head in the rearward position and the power tongs at the forward end of the rig there is mounted a welding station which is preferably automated.

An advantage of the apparatus of this invention is that torque can be applied continuously by the drill rig to the installed casing while additional pipe segments are being joined over long periods of time. Thus pipe segment joinder can occur by welding and X-ray of the weld. Even though these processes occur over substantial periods of time, the accumulation of static friction forces need not occur.

Yet another advantage of this invention is that the installation of drill rig segments can be made at leisure without the danger of pipe freezing. Welding and associated non-destructive testing (for example, X-ray) can occur without freezing.

A further advantage of the power tongs of this invention is that they form an additional source of torque to the casing being installed. Thus where the casing sticks, the tongs at a different location on the pipe can apply torque for freezing the pipe.

Figure 2B:
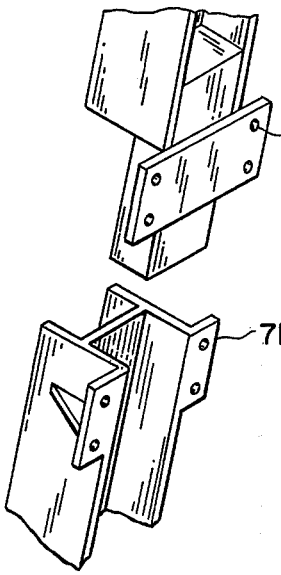
Figure 2A:
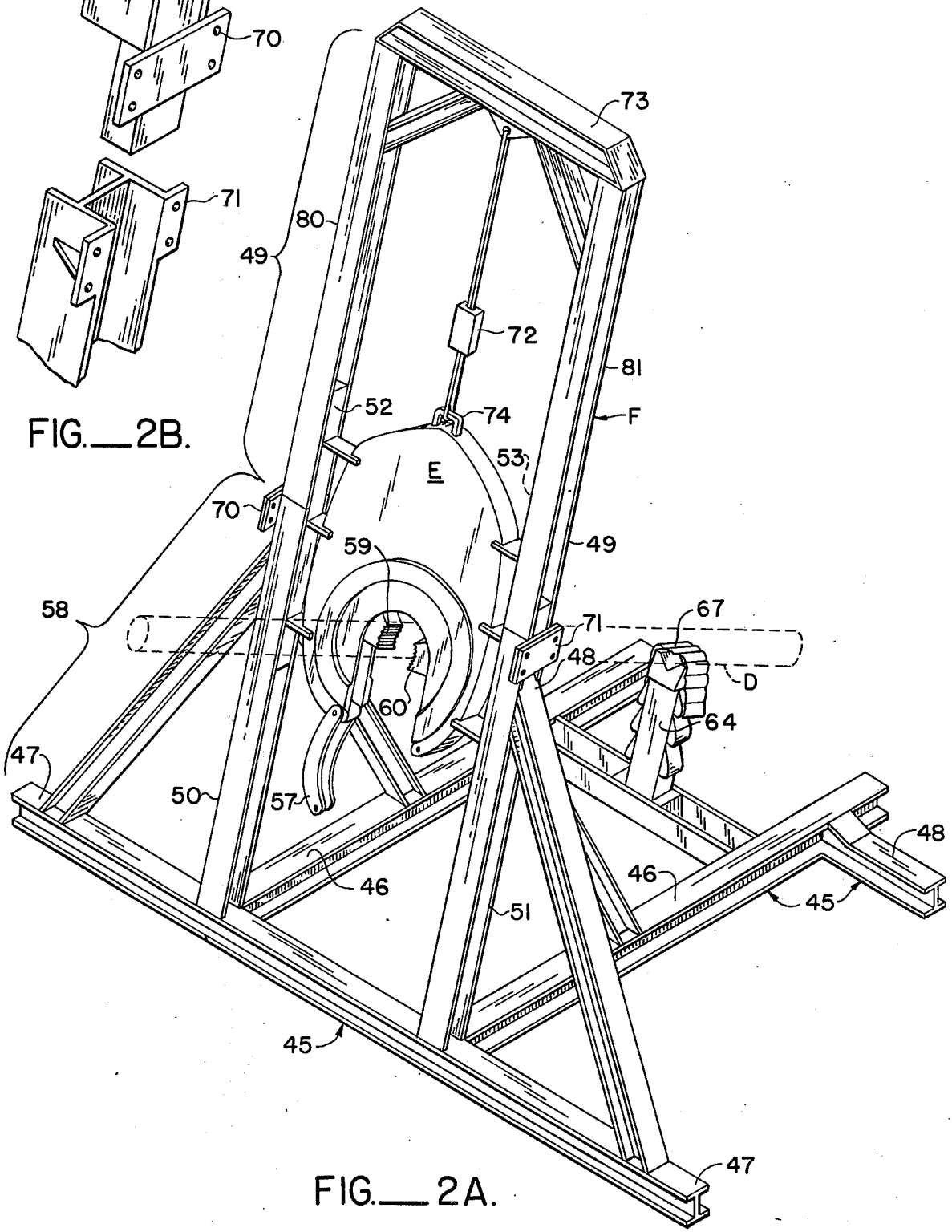
Figure 3A:
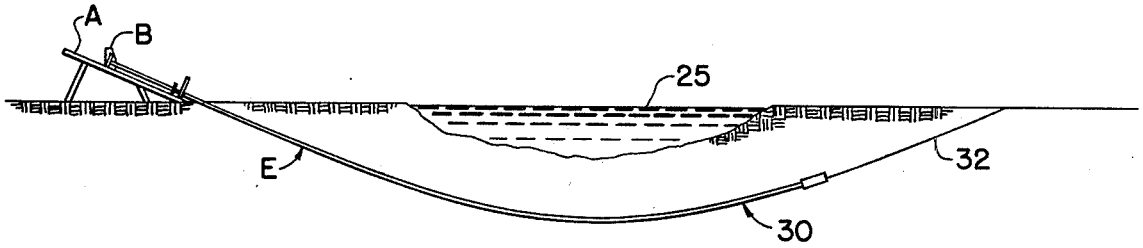
Figure 3B:
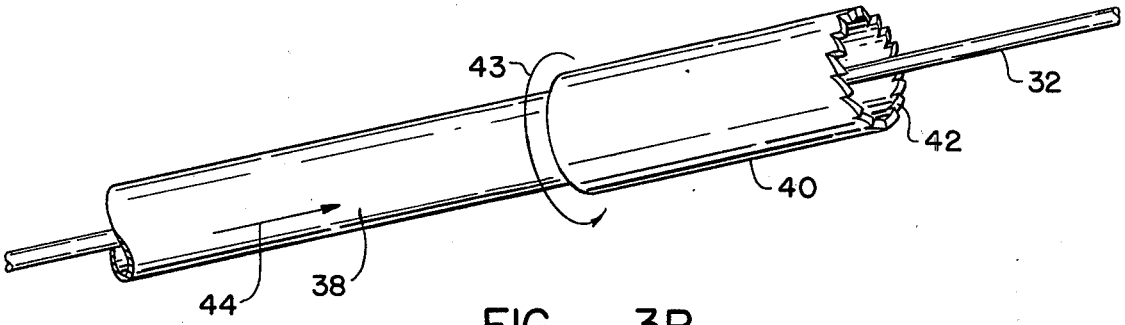
Figure 3C:
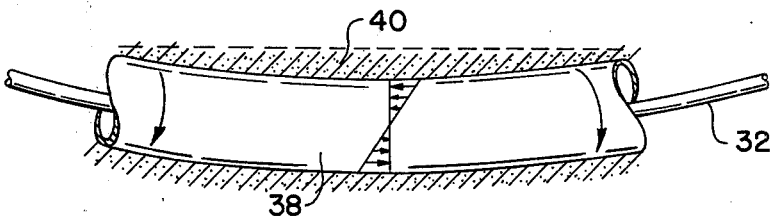
Figure 4A:
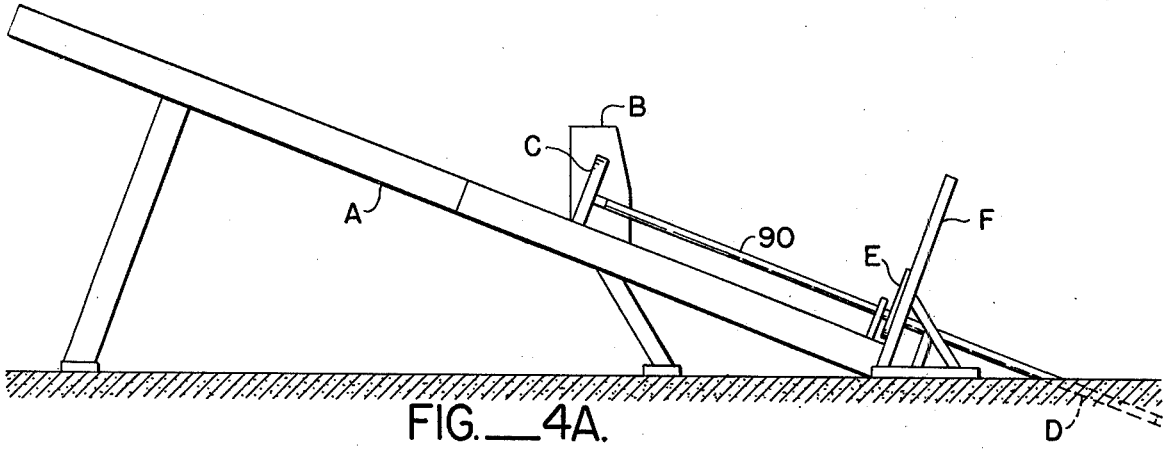
Figure 4B:
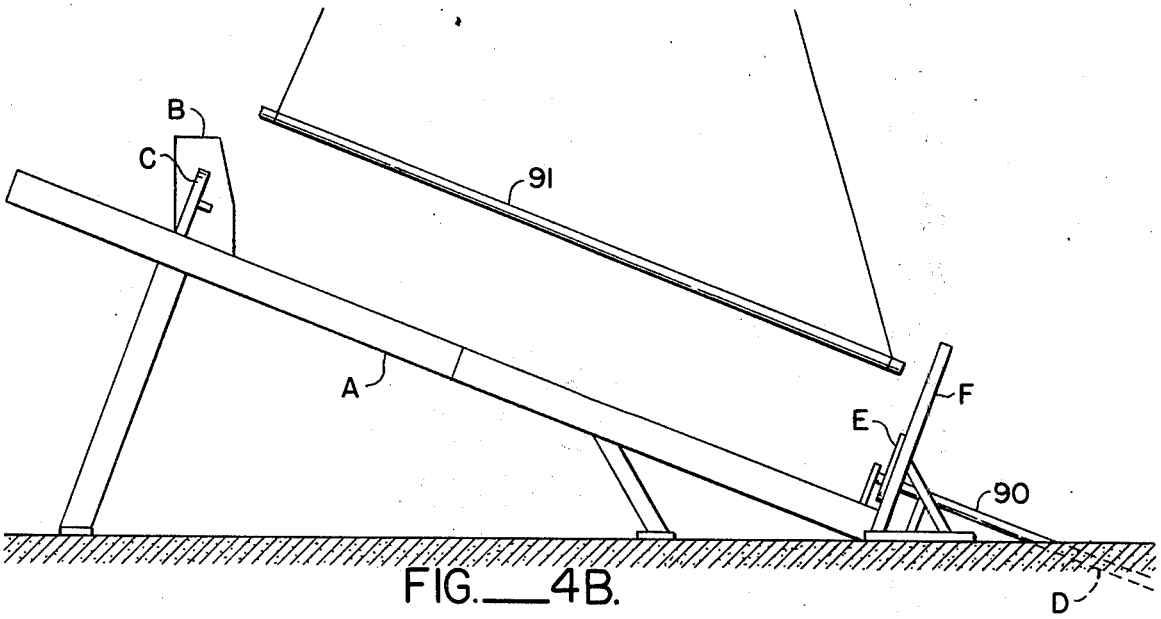
Figure 4C:
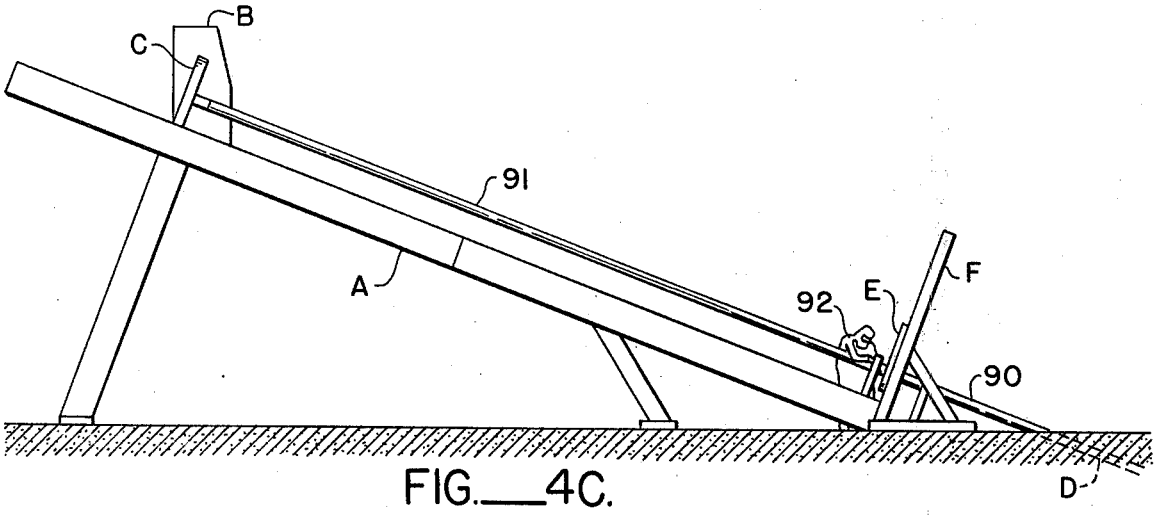

Other objects, features and advantages of this invention will become more apparent after referring to the following specification and attached drawings in which:

FIG. 1 is a perspective elevation view looking upon a drill rig and showing a traveling drill head mounted to an inclined ramp with a ground mounted set of power tongs;

FIG. 2*a* is a perspective view of the power tongs, the view here showing the construction of a bracket for holding the tongs;

FIG. 2*b* is a detail of a connector for joining the top half of the bracket to the bottom half of the bracket;

FIGS. 3*a*, 3*b* and 3*c* are cross sectional views of a production casing being installed almost completely to the point of exit coaxially about a previously installed pilot string with FIGS. 3*b* and 3*c* schematically illustrating the forces on the dirt-exposed segment of casing; and FIGS. 4*a*, 4*b* and 4*c* are sequences illustrating, respectively, crowding of the string into the ground, torquing of the pilot string with simultaneous retreat of the traveling drill head, and attachment of an end segment of pipe together with simultaneous rotation of the drill string by the power tongs.

Referring to FIG. 1, drill rig A having an inclined ramp 12 is illustrated. Traveling car B travels up and down the inclined ramp. Car B includes a rotating drill chuck C which advances pipe segments D into the ground. Such advancement occurs by simultaneously rotating pipe D at chuck C and advancing car B to simultaneously crowd and rotate the drill segment into the ground.

Sequentially, as each pipe segment of pipe D is crowded into the ground, new sections of pipe having a length of less than that of ramp 12 are inserted, fastened to the drill string as by welding, and crowded in their turn by traveling car B and its chuck C into the ground.

Car B and rotating chuck C are described in my copending U.S. patent application Ser. No. 779,459, filed Mar. 21, 1977, entitled "Drill Rig For Boring Underground Inverted Arcuate Paths".

The point of novelty of this invention comprises power tongs E shown mounted to rack F. Power tongs E serve as an apparatus for applying torque to pipe D. This torque applied to pipe D is independent of torque applied at the rotating chuck C. As will be developed hereinafter, power tongs E provide the serendipitous result of greatly reducing the overall torque forces necessary for the installation of pipe D.

Referring in detail to FIG. 1, drill rig A includes ramp 12 having paired rails 14, 15. The ramp and rails are ridden by car B at wheels 17, 18. Car B typically climbs and descends on ramp 12. Such climbing and descent occurs on a table 20 attached to a hydraulically powered drum (not shown) on the underside of car B. Movement of the car and overall direction of the drill rig is provided by drum controls actuated by an operator O in car B.

Heretofore, conventional use of drill rig A has resulted in pipes being installed in invert arcuate paths underneath obstacles, such as river 25 illustrated in FIG. 3*a*. Referring to FIG. 3*a*, a drill rig A with the traveling car B is illustrated having previously installed along an invert arcuate path 30 a pilot string 32 from one side of a river 25 to an opposite side of the river. This can be seen in the section of FIG. 3. The path is an invert arcuate path.

Normally pipe 32 is in the range of three inches of diameter. Ths installation of such a pipe is described in my U.S. Pat. No. 3,878,903 issued Apr. 22, 1975 and entitled APPARATUS AND METHOD FOR DRILLING UNDERGROUND ARCUATE PATHS.

Typically, the invert arcuate contour of the path 30 has to be carefully controlled. Specifically, it must have a radius of curvature which can be followed by the production casing E subsequently installed. For example, where the pilot string 32 is a three inch pipe and the installed production casing 38 is an eight inch pipe, it will be appreciated that the pilot string can take a relatively short radius of curvature. If, however, the production casing 38 is bent to this same short radius of curvature, it can fail. This is because the increased section of the production casing 38 gives the pipe vastly reduced tolerance to being bent.

Referring to the detail of FIG. 3*b*, a perspective view along lines 3*b*—3*b* of FIG. 3*a* is shown. Specifically, a rotating cutting head 40 is installed to the leading edge of the pipe. Rotating cutting head 40 typically includes a series of carbide teeth 42 on the end thereof. By simultaneously rotating cutting head 42 (see arrow 43) and crowding the pipe in the direction indicated by the arrow 44, casing 38 rotates and advances along the previously installed pilot string 32. It threadably rotates over the pilot string 32 and advances from one side of the river 25 to the opposite of the river 25 along the invert arcuate path of the previously installed pilot string 32.

Understanding the installation of the casing 38 about the pilot string 32, the normal sequence of piping installation can be understood.

In normal operation without the power tongs of this invention, a segment of pipe D is installed between the ground and the rotating chuck C. Normally the pipe segment is joined by welding at the drill rig end of the piping D. Such welding normally takes a period of time of several hours and includes non-destructive testing of the weld joint as by X-ray. When this welding has been completed, car B at rotating chuck C simultaneously crowds and rotates piping D into the ground. This normally occurs after the piping D has been in a static disposition in the ground for several hours.

When a pipe has been in a static disposition in the ground for several hours, three forces combine to make a sequential advance and rotation of the piping D into the ground a difficult proposition.

First, the radius of curvature to which pipe 38 is bent places the entire pipe from end to end under a bending force. The increased section of the production casing 38 tends to stiffen this bending force. The pipe as bent resists rotation, as a reversal of stress is required to produce rotation.

Secondly, the entire length of the pipe acts as a torsion spring. When the end of the pipe adjacent the drill rig A is rotated, the remote end of the casing being installed will not rotate. Instead there is from the drill rig end of the pipe E to the reaming head 40 a torsion spring force along the entire length of the production casing being installed. This torsion spring force must be recaptured after relatively long periods of static non-rotation.

Finally, the ambient dirt at 40 along the entire exterior of the production casing 38 exerts a skin friction force upon the pipe. Before the pipe can be rotated this force must be overcome. Where the pipe has been at rest for a period of time exceeding several minutes (more than two minutes), static friction forces grasp the pipe. Resumption of the rotation of the pipe is resisted.

In the normal sequence of events where all rotation of the production casing is stopped, I have discovered that these three forces combine to make the resumption of rotation and advancement of the drill string very difficult. First, the bend in the pipe resists any rotation of the pipe whatsoever. Secondly, the torsion spring force in the pipe from the cutting head 40 back to the drill rig A has to be recaptured. Thirdly, this recapture of this torsion force must work against a static coefficient friction established between the pipe wall 38 and the ambient dirt 40.

It has been found that if a casing being installed in the ground is left in a static disposition for a substantial period of time, freezing of the pipe to the point of its becoming embedded permanently in the ground can occur. Moreover, the forces required to break such pipes loose can exceed up to two and a half times the force required to maintain the pipe moving.

Having set forth with reference to FIGS. 3*a*–3*c* the difficulties of this invention, the construction of the power tong apparatus, and its operation, the process of this invention can now be set forth.

Referring to FIGS. 1 and 2*a*, a pair of power tongs E are shown mounted to a rack F. Rack F includes a base frame section 45 having mounted thereto a hydraulic pipe vise 64. Base frame 45 includes paired beams 46, side extending legs 47, 48, and a pipe vise mount 49. A hydraulic pipe vise 64 here illustrated is a standard item of manufacture of the Houston Engineering Company of Houston, Tex.

In operation, it effects clamping of a pipe by the lapping of a chain 67 over a pipe to be installed with a hydraulic or pneumatic pump being actuated to effect tightening of the chain over the pipe. This vise is capable of clamping the bitter end of a pipe E so that no relative rotation can occur.

Base 45 includes substantially vertical paired I-beams 50, 51 extending upwardly approximately half the distance from the base 45 the total height of the frame. I-beams 50, 51 between their flanges and web define paired opposing U-shaped channels for receiving runners 52, 53 fastened to either side of the power tongs E.

Power tongs E are a standard item of manufacture. They are sold under the trademark ECKEL and manufactured by the Eckel Manufacturing Company, Inc. of Odessa, Tex.

Tongs E include a safety door 57 which opens to receive pipe D therewithin. When the pipe is received in the power tongs E, the safety door 57 is closed and the tongs are actuated for rotation. This self-contained mechanism causes paired jaws 59, 60 to rotate inwardly to grasp the pipe. These jaws first grasp pipe D and thereafter upon continued power being applied, serve to rotate the pipe, without crowding, in the ground. Thus, the power tongs E provide for rotation only of pipe D; crowding of the pipe into the ground does not occur when the power tongs grasp pipe D.

Frame F holding power tongs E is designed to fit around casing D being installed in the ground. Specifically, lower frame section 58 is first placed under and around pipe D being installed. Thereafter, with the safety door 57 open, power tongs E are placed over the pipe. In such placement they are threaded in the opposed U-shaped channels defined by the I-beams 50 and 51 at the runners 52, 53. Thereafter, an upper frame section 49 is placed over the power tongs. This upper section is bolted to the lower section at plates 70, 71 (see detail of FIG. 2*b*). As can be seen, I-beam sections 80, 81 on upper frame section 49 abut and directly overlie the respective I-beams 50, 51. Thus, I-beam sections 80, 81 define together a continuation of the U-shaped track into which the runners 52, 53 on either side of the power tongs E may fit. Raising and lowering of the power tongs E is effected by a chain hoist 72 fastened between and overlying beam members 73 and the power tongs at a lifting ring 74.

Having set forth the function of the power tongs, the sequence of operation of the installation of the production casing can be described with reference to the cartoon series of FIGS. 4*a*–4*c*.

With reference to FIG. 4*a*, a trailing pipe section 90 is shown being rotated and crowded into the ground by chuck C on the car B. As hereinbefore described, chuck C simultaneously rotates and crowds the pipe into the ground.

When car B has fully advanced, power tongs E are typically engaged to pipe segment 90 as is illustrated in FIG. 1. They are used, as engaged, to effect rotation of the pipe segment E without crowding the pipe section E into the ground. Torque from the power tongs is transmitted to the ground by base frame section 58.

At the same time the connection between the chuck C and the pipe segment 90 is broken. As this connection is typically a welded connection, such disengagement is effected by a cutting torch or the like.

Referring to FIG. 4*b*, once chuck C is disconnected from the pipe segment 90, car B with its chuck C is moved upwardly of the ramp. It is moved a spatial interval upwardly of the ramp so that the next sequential segment 91 of pipe can be inserted.

As shown in FIG. 4*c*, pipe 91 is placed in sequence between chuck C and the bitter end of pipe segment 90 previously advanced into the ground. At this juncture, a welder at 92 effects a complete attachment of the pipe segment 91 to the bitter end of the segment 90.

It should be understood that during the steps illustrated in FIGS. 4*b* and 4*c*, rotation of pipe D in the ground occurs. Thus, while the welder is joining pipe segment 91, the entire piping D including the segment 90 and the segment 91 being joined can be at least periodically rotated. This rotation continues through nondestructive testing and continues until the pipe segment 91 is firmly joined to segment 90 and the chuck C and car B are ready to advance the next in order sequential segment 91 into the ground.

When fastening has completely occurred, power tongs E are released. Chuck C on car B serves to rotate and crowd the piping D into the ground.

It is emphasized that the process herein disclosed has the serendipitous result of vastly reducing the forces necessary for advancement of the casing into the ground. Specifically, reductions of up to two and a half times the total torque and crowding force applied to the piping can be realized.

It will be appreciated by those skilled in the piping and drilling art that where pipe is subjected to thrust, bending, and torsional strain, the mechanical limits of the pipe walls can be exceeded. When such limits are exceeded, breakage occurs.

By utilizing the techniques set forth in this invention, the total force applied to a pipe during installation in the ground is reduced. Through the reduction of these forces, production casings can be installed along paths of greater curvature. Moreover, they can be installed along paths of greater lengths.

It should be appreciated that this invention will admit of modification. For example, the power tongs of the preferred embodiment need not be used. Any other apparatus for grasping and rotating the pipe independently of chuck C at the forward end of the inclined drilling rig may be used. Moreover, the illustrated rotational apparatus of this invention including the power tongs E and frame F can either be independently mounted to the ground or alternatively attached to the lower end of the ramp. Similarly, other departures can be made without departing from the spirit and scope of this invention.

I claim:

1. In a drill rig for inserting pipe in an inverted, arcuate path underneath an obstacle such as a river wherein said drill rig includes an inclined ramp, a rotating chuck attached to said ramp, said chuck provided for powered rotation and movement towards and away from the ground along a path defined over said ramp, the improvement to said drill rig comprising: means for grasping and rotating only said pipe at the forward portion of said rig; and means defining a vertical railway proximate the leading end of said ramp, said vertical railway supporting said grasping and rotating means and permitting up and down movement of said grasping and rotating means along a path approximately normal to the axis of said pipe; so that upon actuation of said grasping and rotating means, torque forces can be applied to said piping independent of said chuck attached to said ramp.

2. In combination, an inclined ramp defining over the surface thereof an inclined pathway between a first position at the bottom adjacent the ground and a second position at the top away from the ground; a car movable on said pathway having powered movement between said first and second positions; a rotating chuck mounted to said car and rotatable about an axis substantially parallel to the path of said car on said ramp; said rotating chuck operable to rotate and crowd pipe segments into the ground; means for grasping and rotating pipe segments without crowding, said rotating and grasping means adapted to rotate and grasp pipe being installed in the ground independent of the chuck on said car; and means defining a railway proximate said first position for supporting said grasping and rotating means and for providing motion of said grasping and rotating means towards and away from said pipe along a direction generally normal to the axis of said pipe.

3. The invention of claim 2 and including between said rotating and grasping means and said movable car a welding station, said welding station being sufficiently forward of the upward end of said ramp to permit the sequential installation of pipe segments between said rotating and grasping means and said car moved to the upward end of said ramp.

4. Apparatus for rotating a pipe at the forward end of a drill rig having an inclined ramp with the car movable on a pathway over said ramp, said car having a rotatable chuck for rotating and crowding a pipe into the ground, said rotating apparatus comprising: a base member; a vertical railway extending upwardly from said base member defining a plurality of spaced apart rails; means for grasping and rotating only a pipe attached to said pathway movable along said vertical railway; said grasping and rotating means including a door at one portion thereof for opening and receiving a pipe as said grasping and rotating means is placed over said pipe.

5. The invention of claim 4 and wherein said vertical railway includes a detachably removable upper railway portion, said upper railway portion when removed permitting said grasping and rotating means to be placed over said pipe.

6. The invention of claim 4 and wherein said grasping and rotating means includes hoist means from the upper portion of said railway to said grasping and rotating means to permit said grasping and rotating means to be supported from the upper end of said vertical railway.

* * * * *